US010773946B2

(12) United States Patent
Brander et al.

(10) Patent No.: US 10,773,946 B2
(45) Date of Patent: Sep. 15, 2020

(54) SADDLE

(71) Applicant: ERGON EQUINE LIMITED, Haddington, East Lothian (GB)

(72) Inventors: Michael Brander, East Lothian (GB); Donna Brander, East Lothian (GB); Tracey Ward, East Lothian (GB); Mathew Ward, East Lothian (GB)

(73) Assignee: Ergon Equine Limited, East Lothian (GB)

( * ) Notice: Subject to any disclaimer, the term of this patent is extended or adjusted under 35 U.S.C. 154(b) by 336 days.

(21) Appl. No.: 15/573,036

(22) PCT Filed: May 12, 2016

(86) PCT No.: PCT/GB2016/051363
§ 371 (c)(1),
(2) Date: Nov. 9, 2017

(87) PCT Pub. No.: WO2016/181151
PCT Pub. Date: Nov. 17, 2016

(65) Prior Publication Data

US 2018/0162718 A1 Jun. 14, 2018

(30) Foreign Application Priority Data

May 12, 2015 (GB) ..... 1508101.1

(51) Int. Cl.
*B68C 1/04* (2006.01)
*B68C 1/02* (2006.01)

(52) U.S. Cl.
CPC ..... *B68C 1/04* (2013.01); *B68C 1/02* (2013.01); *B68C 1/025* (2013.01)

(58) Field of Classification Search
CPC ..... B68C 1/00; B68C 1/002; B68C 1/025; B68C 1/04; B68C 1/06; B68C 2001/042; B68C 2001/044
(Continued)

(56) References Cited

U.S. PATENT DOCUMENTS 270,269 A 1/1883 Wilbourn
1,982,839 A 12/1934 Swanson
(Continued)

FOREIGN PATENT DOCUMENTS

DE 102004022048 A1 11/2005
FR 324250 A 3/1903
(Continued)

OTHER PUBLICATIONS

International Search Report and Written Opinion, EPO, dated Jul. 15, 2016, 11 pages.
(Continued)

*Primary Examiner* — Peter M Poon
*Assistant Examiner* — Danielle A Clerkley
(74) *Attorney, Agent, or Firm* — Faegre Drinker Biddle & Reath LLP

(57) ABSTRACT

The improved saddle structure of the invention comprises first and second opposed side panels, a plurality of resilient transverse arched rib members connecting the first and second opposed side panels, and a spine member extending longitudinally between the first and second side panels. The spine member is connected to each rib member at a central crown portion of the rib member. The spine member can comprise one or more elongate members or a plurality of connecting members joining the rib members at their crown portions, and the spine member is of sufficient flexibility to flex with the flexure of the spine of an animal on which the saddle structure is fitted. A saddle seat is secured to the spine
(Continued)

member and/or rib members. The saddle structure of the invention provides a saddle structure for use on the back of an animal whereby localised load pressure points are reduced while allowing flexure of the animal's spine, and whereby load is distributed more evenly along the length of the saddle structure.

19 Claims, 6 Drawing Sheets

(58) Field of Classification Search
USPC ..... 54/37.1, 44.1, 44.3, 66
See application file for complete search history.

(56) References Cited

U.S. PATENT DOCUMENTS 7,178,318 B2 * 2/2007 Swain ..... B68C 1/025 54/44.1
8,627,641 B2 * 1/2014 Brander ..... B68C 1/16 54/37.1
2003/0177742 A1 9/2003 Brownlie
2004/0182051 A1 * 9/2004 Walker ..... B68C 1/02 54/44.3
2004/0244340 A1 * 12/2004 Brownlie ..... B68C 1/08 54/66

FOREIGN PATENT DOCUMENTS

FR 366642 A 10/1906
NL 1035211 C2 9/2009
WO 2010079354 A1 7/2010
WO 2012018466 A1 2/2012
WO WO-2016166351 A1 * 10/2016 ..... B68C 1/02

OTHER PUBLICATIONS

International Search Report and Written Opinion, dated Jul. 15, 2016, 10 pages.
UK Search Report for GB1508101.1, dated Nov. 17, 2015, 5 pages.

* cited by examiner

SADDLE

FIELD OF THE INVENTION

The invention relates to devices for mounting or loading the back of an animal and provides improvements in the way that loads are distributed from the rider or other load to the animal. In particular the invention broadly offers improvements in saddlery and especially provides a new saddle structure design which allows the horse and rider full range of motion.

BACKGROUND OF THE INVENTION

Traditional saddles have a solid backbone or "tree", traditionally made of wood (more recently materials have included fiberglass, metal and plastic), round which a leather (or synthetic equivalent) is mounted. Inevitably placing such a rigid structure on a moving surface such as horse's back can give rise to difficulties with the fit of the saddle to the horse. In the case of some traditional saddles this is partially addressed by using a thick saddle blanket. However with close contact saddles the issue is addressed by attention to fit, either by having a bespoke saddle made for the horse (which is very expensive), or by careful selection from a range of off the peg designs. It is estimated that a saddlery wishing to carry a basic range of off the peg saddles, covering the three main saddle styles (dressage, jumping, general purpose), in one single colour option, and to fit most sizes of horse and rider, would have to stock in excess of 72 different saddles.

Even when a rider invests in a bespoke saddle, the traditional, static design based on a rigid tree does not allow for the changes in a horse's shape that occur as it moves, or as there are variations in its fitness. Even the best fitting saddle cannot distribute the pressure evenly throughout the range of a horse's movement, and even a well fitting tree saddle will inevitably create pressure points on the horse's back, especially when turning tightly, when the saddle tree acts as a longitudinal splint on the spine, or when riding up or down hill or jumping, when the load is transmitted by the tree towards the front or back of the saddle. This can cause pain and restrict movement of the horse, and can potentially leading to a range of physiological and behavioural problems such as bucking, rearing, lameness, bruising of the muscles, muscular atrophy and in more severe cases, tissue necrosis.

New designs of saddle have been developed, both to try to address the problems described above, and to facilitate newly evolved riding disciplines such as endurance and vaulting. All still use a static method of mounting the saddle on the horse. Many of these new designs are described as "treeless", but in practice most are "semi-treed", in that they have a rigid internal fitting at either the pommel or the cantle of the saddle. This can lead to weight being distributed over fewer points than a standard tree, which, in some circumstances, can exacerbate the problem. Saddles that have no tree at all do nothing to spread the pressure of the girth and the stirrups, the full force of which is therefore concentrated immediately over the mounting points. There is also a perception that such saddles are not as secure on the horse, as many treeless designs do not include a gullet, which has the effect of reducing lateral stability. A further disadvantage of many such saddles is that it is difficult to design them to look like the traditional English saddle, a look that is very popular in the market.

An additional issue with traditional close contact saddle design is that the mounting position of the stirrups can be quite critical to the ability of the rider to effectively balance on their horse. Many buyers' choice of saddle is primarily based on this factor, in an attempt to ensure that they are able to sit in the ideal position "over" the stirrups. There is little or no allowance in most saddles for any adjustment of the stirrup bar mounting position, so that this factor can quite severely restrict the choice of saddle, and associated ability to ensure a good fit.

WO2010/079354 describes a "treeless" saddle which has a dynamic load distribution system. The saddle includes several load-bearing sections positioned upon two flexible inner side panels. Line guides are fixed to the sections, and load distribution lines pass through the guides, and loop around free-running pulleys of the stirrup hanger system. A stirrup hanger bar includes diverter pulleys and cooperates with a pulley block to transfer loads through the load-distribution lines to the load-bearing sections around the saddle. The girthing system of the saddle includes webbing members attached to the load-bearing sections. The webbing members are connected to the ends of girth straps so that load is transferred from the girth straps to the load-bearing sections on each side of the saddle. The dynamic load distribution system reduces localised load pressure points and permits flexing of the animal's spine.

In the following discussion, the invention will be generally described in relation to equestrian uses of the invention. However, the invention is broadly applicable to pack animals as well as mounts for personal transport.

It is an object of the invention to obviate or mitigate at least some of the aforesaid problems by providing improvements in saddle design.

SUMMARY OF THE INVENTION

This invention provides a saddle for use on the back of an animal whereby localised load pressure points are reduced while allowing flexure of the animal's spine, and whereby load is distributed more evenly along the length of the saddle.

According to a first aspect of the invention, there is provided a saddle structure comprising:

first and second opposed side panels, a plurality of resilient transverse rib members connecting the first and second opposed side panels, each rib member having a central crown portion, and an elongate spine member extending longitudinally between the first and second side panels, wherein the spine member is connected to the crown portions of the rib members.

The saddle structure may comprise one or more independent transverse rib members which connect the first and second opposed side panels, but which are not connected to the spine member. The saddle structure may have a front end adapted to be located towards the front of an animal and a rear end adapted to be located towards the rear of an animal. One or more of said independent transverse rib members may be provided at the front end of the saddle structure. One or more of said independent transverse rib members may be provided at the rear end of the saddle structure.

Preferably there are at least three resilient transverse rib members connecting the first and second opposed side panels and connected by the spine member. More preferably there are at least four resilient transverse rib members connecting the first and second opposed side panels and connected by the spine member.

Preferably the first and second opposed side panels are spaced apart from each other, and the spine member is located centrally in a space between the first and second opposed side panels.

Preferably the rib members are arched. Preferably the rib members are resilient, such that they can deform under load but revert to their undeformed shape when the load is removed. Preferably the rib members are sufficiently flexible to allow relative movement of the first and second opposed side panels, but are sufficiently rigid to prevent the rib members from contacting the back of an animal when the saddle structure is loaded in use. The ribs may vary in flexibility between rib members. Each rib member may have varying stiffness along its length.

The arched rib members are preferably adapted to maintain a space between the first and second opposed side panels and the back of an animal to which the saddle structure is mounted.

The saddle structure may further comprise a load support surface. The load support surface may be a saddle seat. The load support structure may be attached to the rib members and/or spine member in any appropriate manner, for example by lacing, by straps, by releasable clips, or by apertures in the load support structure which engage with the spine member.

The plurality of arched rib members may include one or more arched rib members which comprise an upper flange and a lower flange. The upper flange may be spaced from the lower flange at the crown portion. The upper flange may be fixed to the lower flange at each end of the upper flange remote from the crown portion.

The arched rib members may be of a material selected from the group comprising carbon fibre reinforced plastic, Kevlar, steel, aluminium, glass reinforced plastic, plastic and wood.

The spine member may be formed integrally with the rib members, for example by moulding. and may be made from the same material.

The spine member may comprise an elongate member of sufficient flexibility to flex with the flexure of the spine of the animal. Preferably the spine member can flex about one or more, most preferably three, of the following: a longitudinal axis substantially parallel to the spine member, a horizontal transverse axis perpendicular to the spine member and a vertical axis perpendicular to the spine member. Preferably the spine member can flex at a plurality of intermediate points along its length in at least one, and preferably all, of three modes, being a twisting mode about a longitudinal axis substantially parallel to the spine member, a bending mode about a horizontal transverse axis perpendicular to the spine member and a bending mode about a vertical axis perpendicular to the spine member. The intermediate points may correspond to connection points between adjacent rib members or between rib members and discs.

The elongate spine member may include a rod or a tube. The elongate spine member may engage structurally with each of the plurality of arched rib members. The elongate spine member may engage with an aperture in a mounting block provided at the crown portion of each of the plurality of arched rib members.

The elongate spine member may be of a material selected from the group comprising carbon fibre reinforced plastic, Kevlar, steel, aluminium, glass reinforced plastic and plastic.

The spine member may further comprise a plurality of inter-segmental members, preferably discs, each member being arranged to contact two adjacent arched rib members. The inter-segmental members may be connected to the rod or tube of the elongate spine member. Each member may be a disc arranged so that it is substantially coplanar with the adjacent arched rib members. The disc may be arranged to allow at least some relative rotation of the adjacent arched rib members and disc about one or more, preferably three, of the following: a longitudinal axis substantially parallel to the spine member, a horizontal transverse axis perpendicular to the spine member and a vertical axis perpendicular to the spine member.

In an alternative embodiment the elongate spine member may comprise a plurality of elongate connecting portions, each connecting portion connecting two adjacent inter-segmental members.

The discs may be of any suitable shape, but preferably include one or more circumferential surfaces of a substantially circular cylindrical form.

The adjacent arched rib members may comprise recesses adapted to engage with a circumferential surface of the adjacent disc, thereby allowing relative rotation of the arched rib member and disc about a vertical axis.

The discs may be of a material selected from the group comprising carbon fibre reinforced plastic, Kevlar, steel, aluminium, glass reinforced plastic and plastic.

In another alternative embodiment the spine member may comprise a plurality of connecting members, each connecting member connecting two adjacent rib members. Each connecting member may include a universal joint allowing relative movement in three modes, being a twisting mode about a longitudinal axis substantially parallel to the spine member, a bending mode about a horizontal transverse axis perpendicular to the spine member and a bending mode about a vertical axis perpendicular to the spine member. Each connecting member may be connected to mounting portions on the ribs. The mounting portions may be lugs or flanges.

The connecting members may be of one or more materials selected from the group comprising carbon fibre reinforced plastic, Kevlar, steel, aluminium, glass reinforced plastic, plastic, steel, stainless steel and metal alloy.

The saddle may include fasteners for attaching the saddle to the back of an animal. The fasteners may comprise one or more girth straps.

The saddle structure may include at least one loading member with an associated load distribution line and corresponding line guides configured to permit loadings applied to the loading member to be distributed between the plurality of rib members.

This reduces localised pressure points upon the back of the animal, while permitting the animal's back to flex.

The opposed side panels may be padded or reinforced.

The saddle structure may further comprise stirrups, each stirrup having an associated loading member. The loading member may be a stirrup hanger. The line guides may include a pulley system to permit distribution of the loading from the stirrups through the load distribution line to the rib members. The stirrup hanger may be a bar of an elongate shape having a length, and intermediate that length is provided an aperture e.g. a horizontal slot for receiving a stirrup leather, and at either end of the bar is provided line guide means. The line guide means may comprise sheaves or other roller devices to allow the line to be diverted where necessary whilst remaining essentially free to move back and forth across the guide means.

Although a conventional stirrup bar may be used in embodiments of the invention, the stirrup hanger may take a variety of suitable shapes, but an oblong flat bar shape may be suitable, with the longer dimension generally being aligned between the head and tail of the animal. The bar is preferably of a suitably strong material such as metal, e.g. stainless steel, or carbon fibre, or a composite material, the said bar being formed with appropriate lightening holes to reduce weight without detriment to strength. At least one aperture in the bar is adapted for suspension of a stirrup leather.

The ends of the stirrup hanger may be adapted to serve as guides for one or more lines. The ends may be angled to hold a line outwardly and away from the saddle to facilitate free-running of the line, and reduce wear and friction thereupon. The ends of the stirrup hanger may incorporate roller devices or a contoured configuration adapted to guide a line in a preferred orientation.

The line may be of wire, cable, rope, or strap of sufficient tensile strength, wear resistance and durability to suit the purpose. The line may be a continuous loop.

In particular the use of a line provides a means of adjustably attaching the stirrup hangers to the saddle, and in normal use of the stirrup hangers by a rider whose weight is transferred to the hangers by stirrups dependent therefrom the line, which serves to distribute the various loadings thereon across the saddle by appropriately positioned guides preferably including at least one at the front and one at the back of the saddle. This type of rig for the stirrups also provides a rider with assistance in maintaining balance due to the additional free movement of the stirrup hanger which will tend to assist the stirrup to naturally fall under the rider's foot.

More than one line may be employed in the system to adjust the positioning of the stirrup bar, and improve control and distribution of different loadings. The line guides are conveniently made of, or coated with, a low friction or slip promoting material to allow the line to freely move over the guide surface, but may include rolling elements e.g. pulleys around which the line may be freely drawn to respond to loadings upon the line. The line guides or runners may include D-rings, O-rings, and tubular sleeve or sheath elements. Smooth or polished metal, ceramics or plastics and resinous materials may be used to form the guides. Such may be made from or optionally coated with slip enhancing materials such as polyamides (Nylon), fluorinated plastics (Teflon), molybdenum disulphide etc.

The use of a line to distribute loadings along the length of the saddle structure permits a more flexible and dynamically responsive saddle to be designed without the need to include a tree or the like support frame elements.

In accordance with a further aspect of the invention, girth straps may be attached to the side panels of the saddle structure by means of webbing configured to distribute loadings from the girth over the flexible side panels. The webbing may be connected to selected rib members of the plurality of rib members, for example to the lower ends of the rib members. Adoption of a "W" configuration for at least part of the webbing is convenient for load distribution from two girth straps.

The side panels may be provided with extensions or skirts and may include flexible gussets or separable or stretchable sections to enhance flexibility and mobility.

The saddle seat may be of any suitable material. Leather or a hard-wearing synthetic fabric is traditionally used as the outer surface material, and wool or synthetic filler materials such as polymer resin foams e.g. polyurethanes, may form the basis for inner layers. Optionally, metal or plastics stiffener elements may be incorporated to improve the shape of parts of the saddle structure, including the saddle seat, without unduly compromising the overall flexibility of the saddle derived from use of a load distribution line system instead of a traditional tree. A suitable flexible material which may be used in the saddle is the material described in WO2005000966, the contents of which are incorporated by reference, and generally comprise a composite material which is elastic, which exhibits a resistive load under deformation which increases with the rate of deformation, which is unfoamed or foamed, comminuted or uncomminuted and which comprises i) a first polymer-based elastic material and ii) a second polymer-based material, different from i), which exhibits dilatancy in the absence of i) wherein ii) is entrapped in a solid matrix of i), the composite material being unfoamed or, when foamed, preparable by incorporating ii) with i) prior to foaming.

DESCRIPTION OF THE DRAWINGS

The invention will now be further described by way of example with reference to the accompanying drawings in which.

MODES FOR CARRYING OUT THE INVENTION

Figure 1:
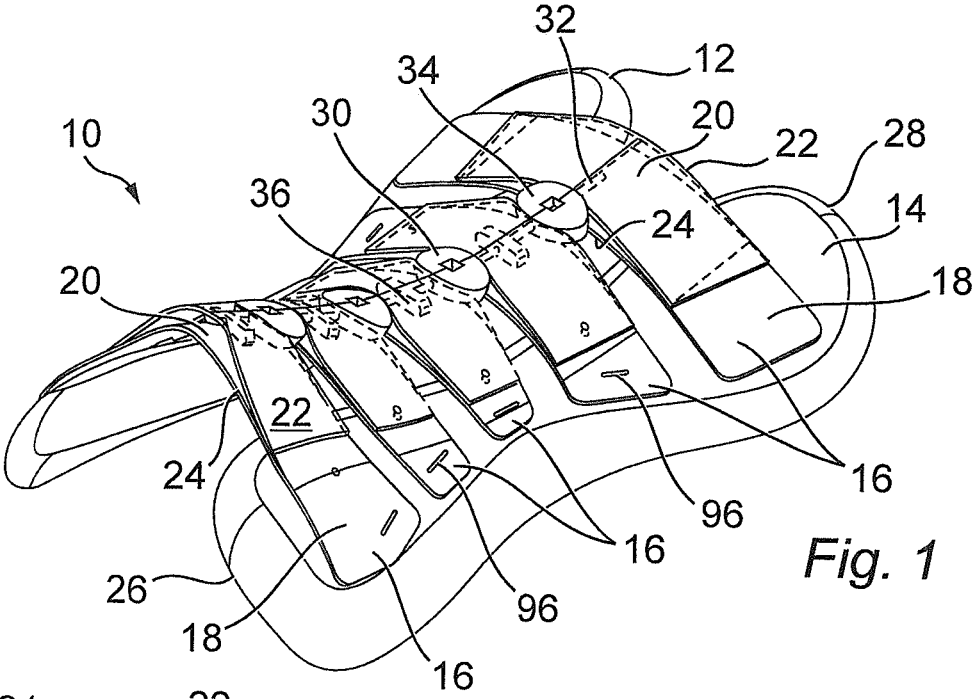
FIG. 1 shows a perspective view from above and from the front to one side of a saddle structure according to one embodiment of the invention, with the saddle seat omitted.
Figure 2:
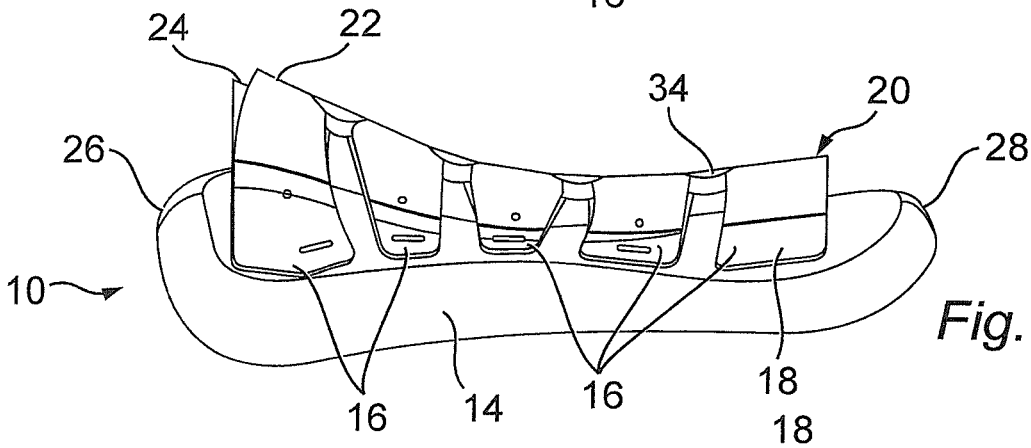
FIGS. 2 and 3 show a side elevation view and a plan view respectively of the saddle structure of FIG. 1.
Figure 3:
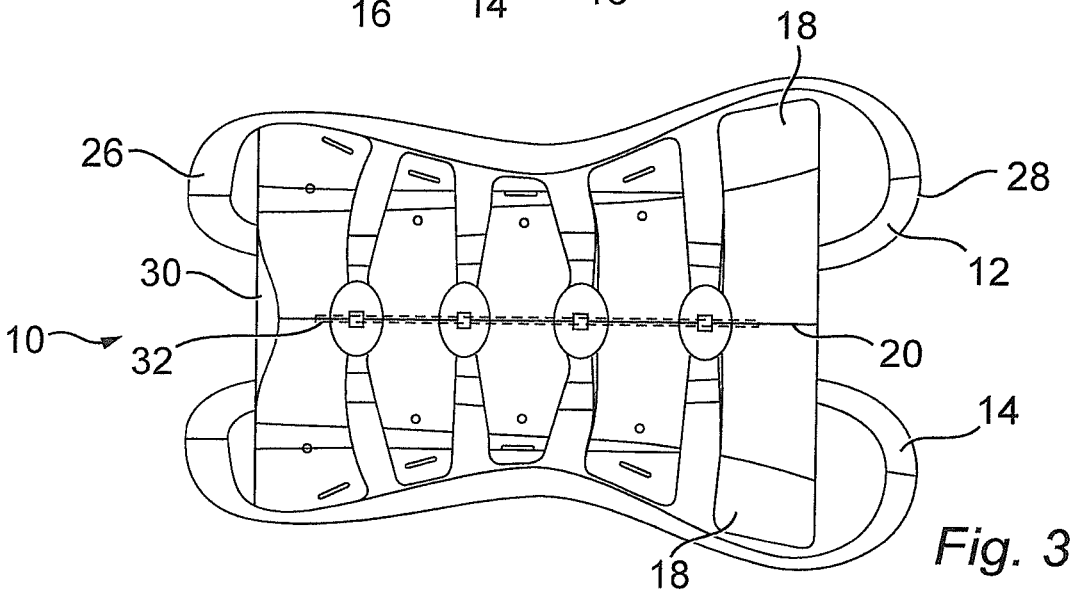

Referring to FIGS. 1 to 3, there is shown a saddle structure 10 for use on a load carrying animal. The saddle structure 10 includes first and second opposed side panels 12, 14, which are connected to each other by five resilient transverse rib members 16. Each rib member 16 is bonded at each of its lower ends 18 to one of the side panels 12, 14. The bonding can be by adhesive, riveting, welding or any other suitable means. The rib members 16 are arched, and each rib member 16 has a crown portion 20 intermediate the ends 18.

In the illustrated example each rib member comprises an upper flange portion 22 and a lower flange 24. The upper flange portion is bonded at its ends to the lower flange portion, to provide a suitably stiff and resilient arched rib member 16. In FIG. 1 the upper flange portion 22 are shown as transparent, so that the spine member 30 is visible. The spine member 30 extends longitudinally between the first and second side panels 12, 14, and in the embodiment of FIG. 1 comprises a spine rod 32 and a plurality of inter-segmental discs 34. The spine rod 32 extends through apertures provided in mounting blocks 36 attached at the crown portion 20 of each rib member 16. In this way the spine member 30 is connected to the crown portions 20 of the rib members 16

In the example of FIG. 1 the spine member 30 connects all five rib members 16. However there may be provided more or fewer rib members 16, and the spine member 30 may connect only a number of the rib members 16. For example, the saddle structure 10 may comprise one or more independent transverse rib members 16 which connect the first and second opposed side panels 12, 14, but which are not connected to the spine member 30. One or more independent transverse rib members may be provided either at the front end 26 of the saddle structure 10, or at the rear end 28 of the saddle structure 10, or at both ends 26, 28.

The rib members 16 are sufficiently flexible to allow relative flexural movement of the first and second opposed side panels 12, 14, but are sufficiently rigid to prevent the rib members from contacting the back of an animal when the saddle structure 10 is loaded in use. Although in the illustrated example the rib members 16 are shown having a sandwich structure, with upper and lower flanges 22, 24 in order to reduce weight, the rib members 16 may be solid and one-piece, as long as they exhibit the required resilience and stiffness. The arched rib members 16 maintain a space between the opposed side panels 12, 14 and the back of an animal to which the saddle structure is mounted, so that the spine of the animal is free to move and flex. The spine member 30 of the saddle structure can move with the spine of the animal, while ensuring that the load carried by the saddle structure 10 is adequately transferred to the animal through the side panels 12, 14.

Figure 4:
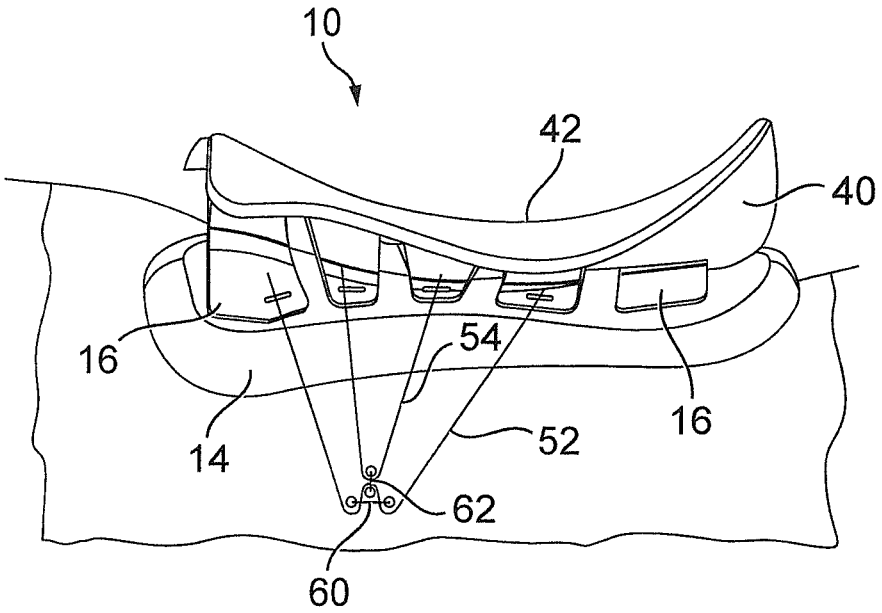
FIG. 4 shows a side elevation view of the saddle structure of FIG. 1 with the saddle seat and a schematic representation of the load distribution line.
Figure 5:
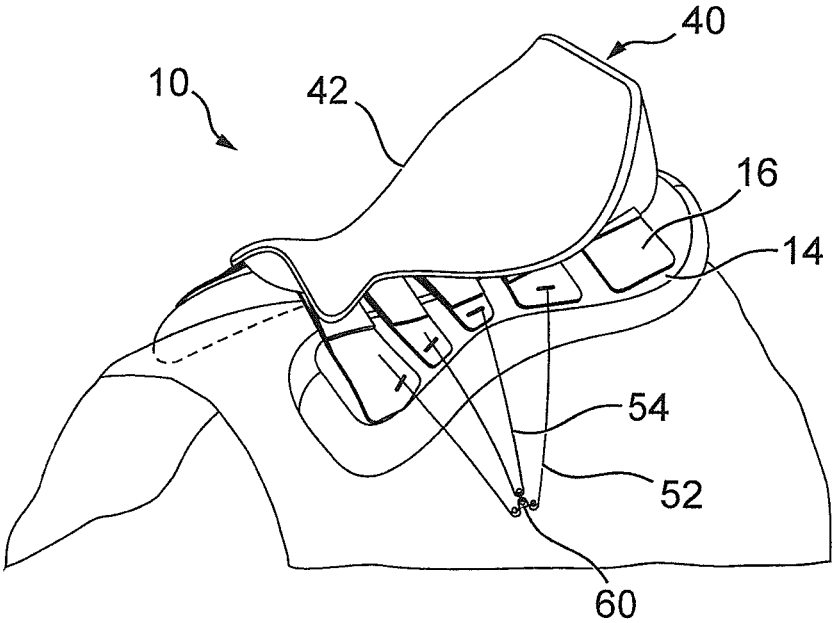
FIG. 5 shows a perspective view from above and from the front to one side of the saddle structure of FIG. 4.
Figure 10:
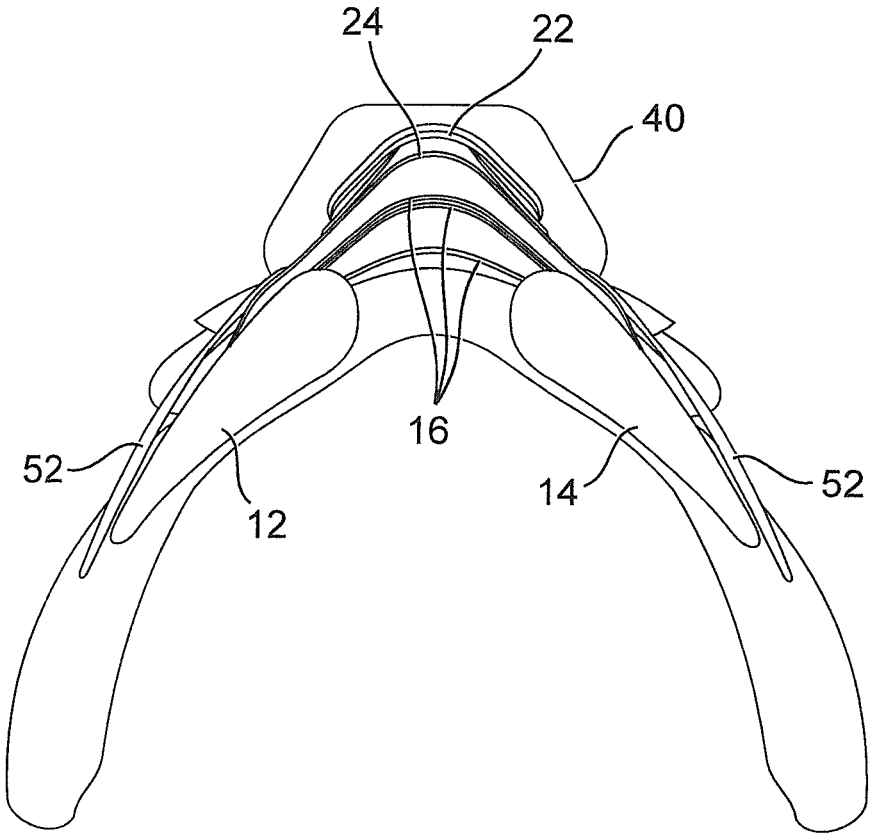
FIG. 10 shows an elevation from the rear of the saddle structure of FIG. 4.

FIGS. 4, 5 and 10 show a load support structure in the form of a saddle seat 40 fixed to the saddle structure 10 of FIGS. 1 to 3. The saddle seat 40 includes a load support surface, which in this embodiment is the upper surface 42 of the saddle seat 40 on which a rider sits. The load support structure 40 may be attached to the rib members and/or spine member in any appropriate manner, including those attachment means known in the art. By way of example only, the saddle seat 40 may be attached by lacing, straps, releasable clips or other fasteners (not shown) to one or more of the rib members, or to separate attachment means provided on the rib members 16. Alternatively the rib members 16 may be provided with projecting portions (not shown) which engage with recesses (not shown) on the saddle seat 40.

Alternatively the underside of the saddle seat 40 may be provided with projecting portions (not shown) which engage with recesses (not shown) on the rib members 16 or spine member 30. Alternatively the spine rod 32 may be threaded through apertures provided in projecting portions on the underside of the saddle seat 40 to securely attach the saddle seat 40 to the spine member 30.

The arched rib members 16 may be of carbon fibre reinforced plastic, Kevlar, steel, aluminium, metal alloy, glass reinforced plastic, plastic, wood, any other suitable material or a combination of these.

It is important that the spine member 30 has sufficient flexibility to flex with the flexure of the spine of the animal. Since the spine of the animal can flex in three degrees of freedom, by bending about a horizontal axis, by bending about a vertical axis and by twisting about its own longitudinal axis, it is preferable that the spine member 30 can also flex about one or more, most preferably three, of the following: twisting about a longitudinal axis substantially parallel to the spine member 30, bending about a horizontal transverse axis perpendicular to the spine member 30 and bending about a vertical axis perpendicular to the spine member. The components of the spine member 30 should thus be chosen to permit this flexibility. In the illustrated example the spine member 30 includes a single elongate member in the form of a spine rod 32, which may be tubular or solid. However the spine member 30 may be formed segmentally, or it may be formed as one-piece with the rib members 16, for example by moulding. The elongate member may be of carbon fibre reinforced plastic, Kevlar, steel, aluminium, metal alloy, glass reinforced plastic, plastic, any other suitable material or a combination of these.

In the embodiments illustrated in FIGS. 1 to 5 the spine member 30 includes a plurality of inter-segmental discs 34. Each disc 34 is arranged to contact two adjacent arched rib members 16. The discs 34 help control the flexural stiffness of the spine member 30. The discs 34 are substantially coplanar with the adjacent arched rib members 16. The discs 34 allow at least some relative rotation of each disc 34 and its adjacent arched rib members 16 about one or more, preferably three, of the following: a longitudinal axis substantially parallel to the spine member 30, a horizontal transverse axis perpendicular to the spine member 30 and a vertical axis perpendicular to the spine member 30. As can be seen in FIG. 1, in one embodiment the spine rod 32 passes through a longitudinal aperture in each disc 34, so that the spine rod 32 has alternate rib members 16 and discs 34 threaded thereon.

The discs 34 in the illustrated embodiment are substantially elliptical in plan, although they can be of any suitable shape, for example circular or even quadrilateral. However it is advantageous if the discs 34 have circumferential bearing surfaces of a substantially circular part-cylindrical form with which they are in contact with a recess of corresponding substantially circular part-cylindrical form, so that the two surfaces can rotate one against the other to permit relative rotation of the disc 34 and its adjacent arched rib member 16 about a vertical axis perpendicular to the spine member 30. Alternatively the discs 34 may have a small contact area with the adjacent arched rib member 16, such that the contact area acts substantially as a point contact and permits relative rotation.

The discs 34 may be of carbon fibre reinforced plastic, Kevlar, steel, aluminium, metal alloy, glass reinforced plastic, plastic, any other suitable material or any combination of these.

It is to be understood that the discs 34, spine member 30 and rib members 16 may all be formed as one piece, for example by moulding. Alternatively the discs 34 may be omitted, and the rib members 16 may contact each other at the crown portions, for example by having a wider crown portion 20 than the remainder of the rib member 16. In such an arrangement the spine member 30 and rib members 16 may be formed and connected separately, or they may be formed as one piece, for example by moulding.

Figure 6:
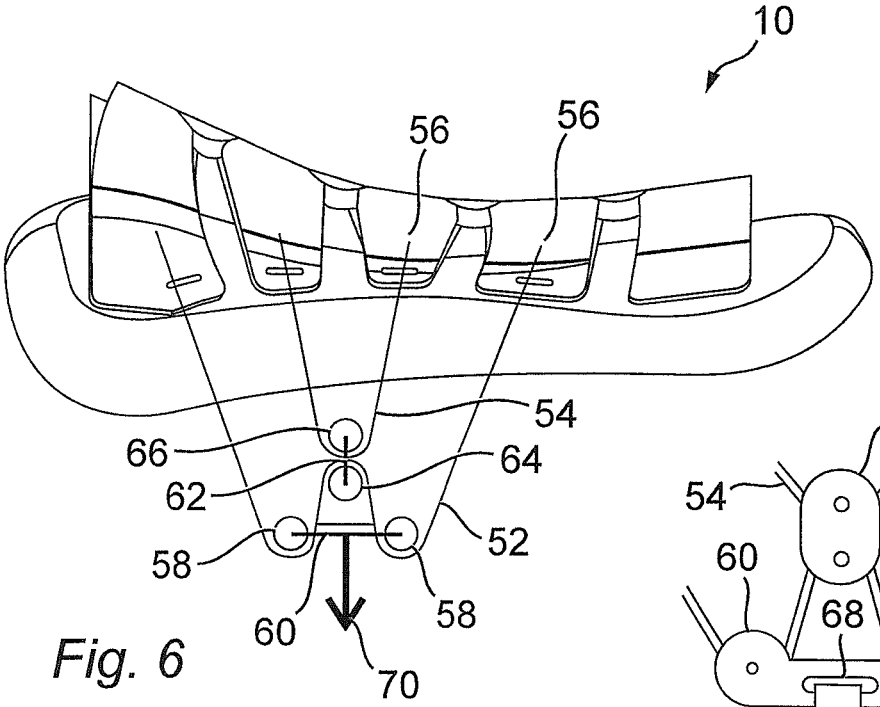
FIG. 6 shows a side elevation view of the saddle structure of FIG. 1 with a schematic representation of the load distribution line.
Figure 7:
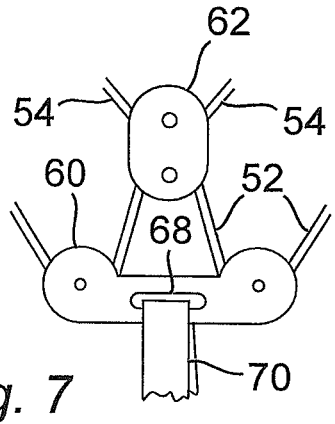
FIG. 7 shows a partial view of the structural elements of the load distribution line shown schematically in FIG. 6.

FIGS. 6 and 7 illustrate an embodiment of a dynamically rigged stirrup hanger system 50 which can be used with the saddle structure 10 of the present invention.

The saddle structure may include at least one loading member with an associated load distribution line and corresponding line guides configured to permit loadings applied to the loading member to be distributed between the plurality of rib members. This reduces localised pressure points upon the back of the animal, while permitting the animal's back to flex.

First and second high tensile load distribution lines 52, 54, which may be wire cable or fine nylon rope, are each secured at their ends to the lower ends of the rib members 16. Any suitable means of attachment can be used, for example by tying to fixing points 56, such as the eyelets 56 illustrated in FIG. 8. If required further line guides (not shown), for example eyelets, may be provided on the rib members 16 below the fixing points 56. The lines 52, 54 loop around free-running pulleys of the stirrup hanger system 50.

Two diverter pulleys 58 for the first line 52 are provided within a stirrup hanger or stirrup hanger bar 60, including sheaves or the like roller devices. A tandem pulley block 62 of known design is provided with lower and upper pulleys 64, 66 for the first and second lines 52, 54 respectively, including sheaves or the like roller devices. The pulleys and lines are shown schematically in FIG. 6, while FIG. 7 shows the arrangement of the stirrup hanger bar 60 and tandem pulley block 62.

The stirrup hanger bar 60 includes attachment means (in the illustrated example a slot 68) to which stirrup straps 70 can be attached. Any load applied to the stirrup straps is thus divided between the four fixing points 56, no matter what the state of flexure of the saddle structure. This reduces localised pressure points upon the back of the animal, while permitting the animal's back to flex.

Although this embodiment has been described with reference to stirrup hangers, the invention is equally applicable to use with other loading members, when used with an associated load distribution line and corresponding line guides configured to permit loadings applied to the loading member to be distributed between the plurality of rib members.

A greater or lesser number of pulleys and line guides may be used in other embodiments of the stirrup hanger system 50. Many variants of the dynamic load distribution system are possible within the scope of the invention. Reference is made to WO2010/079354, which discloses other arrangements of lines and pulleys which may be used with the saddle structure 10 of the present invention.

The use of lines to attach the stirrup hanger in this way allows the stirrup hanger to be moved forwards or backwards on the saddle structure to suit the size of the rider, while still distributing the load from the stirrups along the length of the saddle structure.

Figure 8:
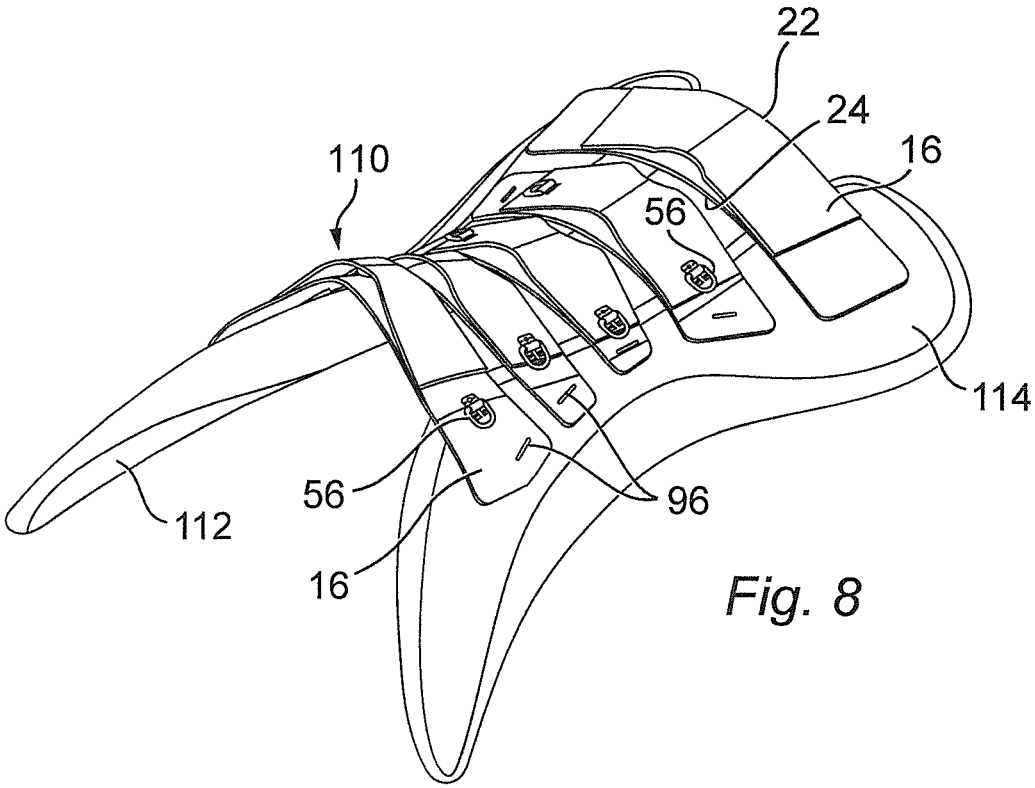
FIG. 8 shows a perspective view from above and from the front to one side of a saddle structure according to another embodiment of the invention, with the saddle seat omitted.

FIG. 8 shows another embodiment of a saddle structure 110 according to the invention. The side panels 112, 114 have a different shape. The spine member 30 has been omitted for clarity. However in all other respects the saddle structure 110 functions in the same way as that of FIG. 1.

Figure 9:
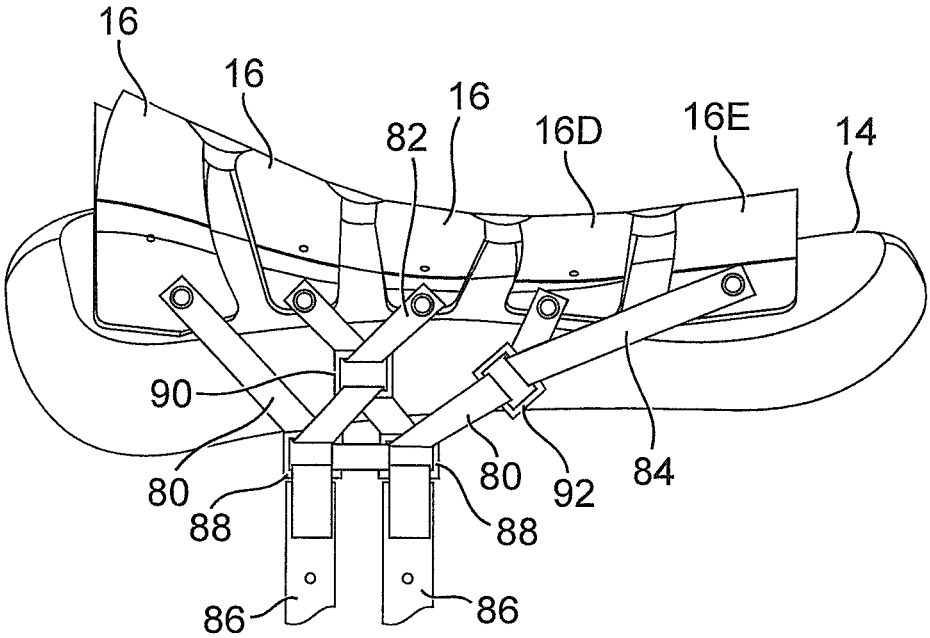
FIG. 9 shows a side elevation view of the saddle structure of FIG. 1 with a "W"-style girthing support system of webbing attached to the rib members, which is suitable for use in any of the embodiments of the invention.

Referring now to FIG. 9, a girthing system for use with the saddle structure 10, 110 described above comprises webbing 80, 82, 84 attached to the rib members 16 so as to depend therefrom and form a generally W-shaped configuration to which the ends of the girth straps 86 can be fastened through buckles 88, and the load transferred at least in part through the webbing 80, 82, 84 and intermediate buckles 90, 92 to the rib members 16 on each side of the saddle structure 10. If required the third webbing member 84 and the second buckle 92 can be omitted, and the first webbing member 80 attached directly to the fourth rib member 16D, so that there is no tension transferred from the girth straps 86 to the fifth rib member 16E.

Any tension in the girth straps is thus divided between the five (or four) fixing points 94, no matter what the state of flexure of the saddle structure. In the example of FIG. 9 the webbing is shown connected to the rib members 16 by ring connectors 94 at the fixing points, which permit relative rotation of the webbing and rib member. However any suitable connection means can be used, for example the slot connectors 96 illustrated in FIG. 1.

In use, the pressure applied through the girth straps and load distribution line system in conjunction with padding (not shown) provided on the underside of the side panels 12, 14 selectively maintains the gullet at the desired clearance of the withers on a wide variety of horses. This clearance defined between the ceiling of the gullet and side walls of the padding and above the spine of the horse spaces the saddle seat from the horse, and avoids the direct weight of the rider being localised upon a few vertebrae which would otherwise cause severe discomfort to the horse and shorten its working life.

Figure 11:
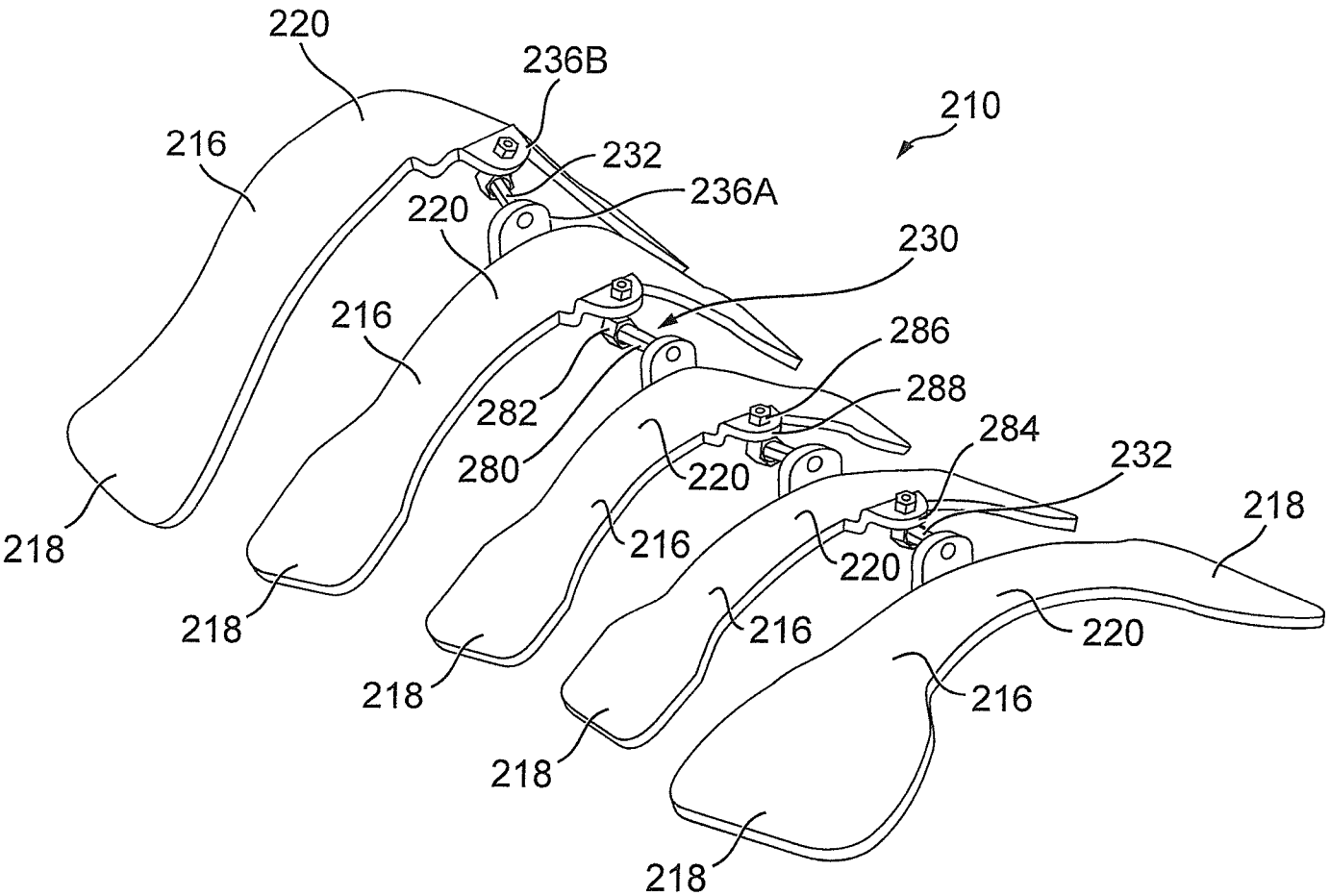
FIG. 11 shows a perspective view from above of a saddle structure according to another embodiment of the invention, with the saddle seat and side panels omitted.

FIG. 11 shows another embodiment of a saddle structure 210 according to the invention. The saddle seat and the side panels, which are similar to those illustrated in the embodiments of FIG. 1 or FIG. 8, are omitted for clarity. The rib members 216 are arched, and each rib member 216 has a crown portion 220 intermediate the ends 218. The ends 218 are secured to the side panels (not shown).

The spine member 230 in this embodiment comprises a number of four connecting members 232 which connect mounting blocks 236A, 236B provided at the crown portion 220 of each rib member 216. Each connecting member 232 includes a rod portion 280 fixed to a lug-shaped mounting block 236A on a first rib. The rod portion 280 has a universal joint socket 282 on its end. A universal joint ball 284 is provided on the end of a fixing bolt 286 fixed to a flange 288 on a mounting block 236B on a second rib. The universal joint ball 284 engages with the universal joint socket 282 to provide the required flexure in three modes, namely a twisting mode about a longitudinal axis substantially parallel to the spine member 230, a bending mode about a horizontal transverse axis perpendicular to the spine member 230 and a bending mode about a vertical axis perpendicular to the spine member 230.

Although in this embodiment the spine member 230 comprises a number of separate connecting members 232 each connecting the ribs together, it functions in the same way as the continuous spine member described in previous embodiments. Hence the saddle structure 110 functions in the same way as that of FIG. 1.

In equestrian use, the rider mounts and rides as with a conventional saddle structure, but the improved load distribution of the saddle structure of the present invention improves the comfort of the rider and the comfort and performance of the horse, due to improved mobility of the horse's spine, and reduced likelihood of injury and discomfort provided by the saddle structure of this invention.

Various advantages are evident due to the invention including the following. The invention spreads the load imposed by the girth and/or stirrups bearing the weight of the rider. This invention addresses the problem of pressure points caused by ill-fitting saddles, allows for easier and less bespoke saddle fitting, improves freedom of movement in the horse or other animal to which the saddle is fitted, reduces the likelihood of behavioural problems arising due to discomfort, and increases the range of stirrup mountings where the rider is properly positioned 'over' the stirrups.

The avoidance of a rigid frame or tree, and the adoption of a spine member and rib members into the saddle structure, in a manner which echoes the animals own spine and rib structure, allows the saddle to move more sympathetically and harmoniously with the horse and rider movements, thereby greatly reducing inhibitions upon horse movement, mitigating fatigue, reducing injury and behavioural issues, while allowing improved responsiveness to rider control, ultimately increasing rider safety.

The invention is not restricted to use on horses, and will work equally well in any other circumstances e.g. for use on mules, donkeys or other pack animals where a saddle or backpack is used and it is desirable to distribute the pressure of the mounting or of stirrups as appropriate. This would include girthing of pack saddles and mounting of packs themselves. Thus the preferred girthing and stirrup mountings can be independently used to benefit with a suitably adapted load distribution line and guide system of this invention.

The invention claimed is:

1. A saddle structure comprising:

first and second opposed side panels, a plurality of resilient transverse rib members connecting the first and second opposed side panels, each rib member having a central crown portion, and a spine member extending longitudinally between and spaced apart from the first and second side panels, wherein the spine member is connected to each pair of adjacent crown portions of the rib members, and wherein the spine member is of sufficient flexibility to flex with the flexure of the spine of the animal in three modes between each pair of adjacent crown portions, the three modes being a twisting mode about a longitudinal axis substantially parallel to the spine member, a bending mode about a horizontal transverse axis perpendicular to the spine member and a bending mode about a vertical axis perpendicular to the spine member, wherein the spine member comprises one or more elongate rod members, and wherein the spine member further comprises a plurality of inter-segmental members connected to the one or more rod members, each inter-segmental member being arranged to contact two adjacent rib members.

2. A saddle structure according to claim 1, comprising at least three resilient transverse rib members connecting the first and second opposed side panels, each rib member having a central crown portion, wherein the spine member is connected to the crown portions of the rib members.

3. A saddle structure according to claim 1, wherein the first and second opposed side panels are spaced apart from each other to provide a space therebetween, and the spine member is located centrally above the space between the first and second opposed side panels.

4. A saddle structure according to claim 1, wherein the rib members are arched and are sufficiently rigid to prevent the rib members from contacting the back of an animal when the saddle structure is loaded in use.

5. A saddle structure according to claim 1, further comprising a saddle seat secured above the rib members.

6. A saddle structure according to claim 1, wherein the spine member engages structurally with each of the plurality of rib members.

7. A saddle structure according to claim 1, wherein each inter-segmental member is a disc.

8. A saddle structure according to claim 1, wherein the spine member comprises a plurality of connecting members, each connecting member connecting two adjacent rib members.

9. A saddle structure according to claim 8, wherein each connecting member includes a universal joint allowing relative movement in three modes, being a twisting mode about a longitudinal axis substantially parallel to the spine member, a bending mode about a horizontal transverse axis perpendicular to the spine member and a bending mode about a vertical axis perpendicular to the spine member.

10. A saddle structure according to claim 1, wherein the crown portions of adjacent rib members are in contact with each other.

11. A saddle structure according to claim 1, wherein the rib members and spine member are integrally formed.

12. A saddle structure according to claim 1, wherein the saddle structure includes at least one loading member with an associated load distribution line connected to the rib members and corresponding line guides configured to permit loadings applied to the loading member to be distributed between the plurality of rib members.

13. A saddle structure according to claim 12, wherein the saddle structure further comprises stirrups, each stirrup having an associated loading member, wherein the associated loading member is a stirrup hanger, each stirrup hanger having an associated load distribution line connected to the rib members and corresponding line guides.

14. A saddle structure according to claim 1, further comprising girth straps attached to the side panels of the saddle structure by means of webbing configured to distribute loadings from the girth over the side panels.

15. A saddle structure according to claim 14, wherein the webbing is connected to selected rib members of the plurality of rib members.

16. A saddle structure comprising: a plurality of resilient transverse rib members, each rib member having a central crown portion, and a central spine member having a length and extending longitudinally with the rib members grouped in pairs with each pair connected on opposite lateral sides of the central spine member and the pairs being spaced longitudinally apart from one another along the length of the central spine member, wherein the central spine member is connected to each pair of adjacent crown portions of the rib members, and wherein the central spine member is of sufficient flexibility to flex with the flexure of the spine of the animal in three modes between each pair of adjacent crown portions, the three modes being a twisting mode about a longitudinal axis substantially parallel to the central spine member, a bending mode about a horizontal transverse axis perpendicular to the central spine member and a bending mode about a vertical axis perpendicular to the central spine member, wherein the central spine member comprises one or more elongate rod members, and wherein the central spine member further comprises a plurality of inter-segmental members connected to the one or more rod members, each inter-segmental member being arranged to contact two adjacent rib members.

17. A saddle structure comprising:

first and second opposed side panels, a plurality of resilient transverse rib members connecting the first and second opposed side panels, each rib member having a central crown portion, and a spine member extending longitudinally between and spaced apart from the first and second side panels, wherein the spine member is connected to each pair of adjacent crown portions of the rib members, wherein the spine member is of sufficient flexibility to flex with the flexure of the spine of the animal in three modes between each pair of adjacent crown portions, the three modes being a twisting mode about a longitudinal axis substantially parallel to the spine member, a bending mode about a horizontal transverse axis perpendicular to the spine member and a bending mode about a vertical axis perpendicular to the spine member, wherein the spine member comprises a plurality of connecting members, each connecting member connecting two adjacent rib members, and wherein each connecting member includes a universal joint allowing relative movement in three modes, being a twisting mode about a longitudinal axis substantially parallel to the spine member, a bending mode about a horizontal transverse axis perpendicular to the spine member and a bending mode about a vertical axis perpendicular to the spine member.

18. A saddle structure comprising:

a plurality of resilient transverse rib members, each rib member having a central crown portion, and a spine member extending longitudinally to connect the rib members, wherein the spine member is connected to each pair of adjacent crown portions of the rib members, and wherein the spine member is of sufficient flexibility to flex with the flexure of the spine of the animal in three modes between each pair of adjacent crown portions, the three modes being a twisting mode about a longitudinal axis substantially parallel to the spine member, a bending mode about a horizontal transverse axis perpendicular to the spine member and a bending mode about a vertical axis perpendicular to the spine member, wherein the spine member comprises one or more elongate rod members, and wherein the spine member further comprises a plurality of inter-segmental members connected to the one or more rod members, each inter-segmental member being arranged to contact two adjacent rib members.

19. A saddle structure comprising:

a plurality of resilient transverse rib members, each rib member having a central crown portion, and a spine member extending longitudinally to connect the rib members, wherein the spine member is connected to each pair of adjacent crown portions of the rib members, wherein the spine member is of sufficient flexibility to flex with the flexure of the spine of the animal in three modes between each pair of adjacent crown portions, the three modes being a twisting mode about a longitudinal axis substantially parallel to the spine member, a bending mode about a horizontal transverse axis perpendicular to the spine member and a bending mode about a vertical axis perpendicular to the spine member, wherein the spine member comprises a plurality of connecting members, each connecting member connecting two adjacent rib members, wherein each connecting member includes a universal joint allowing relative movement in three modes, being a twisting mode about a longitudinal axis substantially parallel to the spine member, a bending mode about a horizontal transverse axis perpendicular to the spine member and a bending mode about a vertical axis perpendicular to the spine member.

* * * * *